US006223825B1

(12) United States Patent
Ingebrigtsen et al.

(10) Patent No.: US 6,223,825 B1
(45) Date of Patent: May 1, 2001

(54) SWIVEL

(75) Inventors: Atle Ingebrigtsen, Nesttun; Jørgen Eide, Stend, both of (NO)

(73) Assignee: Den Norske Stats Oljeselskap A.S, Stavanger (NO)

( * ) Notice: Subject to any disclaimer, the term of this patent is extended or adjusted under 35 U.S.C. 154(b) by 0 days.

(21) Appl. No.: 09/242,959

(22) PCT Filed: Aug. 21, 1997

(86) PCT No.: PCT/NO97/00220

§ 371 Date: Feb. 26, 1999

§ 102(e) Date: Feb. 26, 1999

(87) PCT Pub. No.: WO98/09052

PCT Pub. Date: Mar. 5, 1998

(30) Foreign Application Priority Data

Aug. 27, 1996 (NO) ..... 963587

(51) Int. Cl.[7] ..... F21B 33/038

(52) U.S. Cl. ..... 166/345; 166/355; 166/368

(58) Field of Search ..... 166/341, 345, 166/346, 347, 351, 352, 353, 354, 355, 368, 366

(56) References Cited

U.S. PATENT DOCUMENTS

| | | | | |
|---|---|---|---|---|
| 3,750,749 | | 8/1973 | Giroux . | |
| 4,326,312 | | 4/1982 | Tang . | |
| 4,668,126 | * | 5/1987 | Burton | 166/345 |
| 5,148,871 | * | 9/1992 | Gullion | 166/355 |
| 5,288,253 | * | 2/1994 | Usrdshals et al. | 166/355 |

FOREIGN PATENT DOCUMENTS

| | | |
|---|---|---|
| 2 656 274 | 6/1991 | (FR) . |
| 1 549 766 | 8/1979 | (GB) . |
| 2 168 939 | 7/1986 | (GB) . |
| 2 273 087 | 8/1994 | (GB) . |
| 87/1005 | 10/1988 | (NO) . |
| 93/177780 | 8/1995 | (NO) . |
| 95/01904 | 1/1995 | (WO) . |
| 95/021146 | 1/1995 | (WO) . |
| 97/30887 | 8/1997 | (WO) . |

* cited by examiner

*Primary Examiner*—David Bagnell
*Assistant Examiner*—Frederick L. Lagman
(74) *Attorney, Agent, or Firm*—Foley & Lardner

(57) ABSTRACT

A swivel assembly for installation at a well for subsea production of oil or gas and adapted to be connected to a production vessel at the sea surface. The swivel assembly comprises a main fluid swivel having at least two paths and an electric/hydraulic auxiliary swivel for signal communication and power transfer. The fluid swivel is provided with a rotatable swivel housing at the top of a stationary christmas tree, preferably comprising a small number of valves, such as a production master valve and an annulus master valve. The paths are through-running vertically in the central core member of the fluid swivel so as to make possible well intervention from the upper side of the fluid swivel.

20 Claims, 2 Drawing Sheets

SWIVEL

FIELD OF THE INVENTION

This invention relates to a swivel device for installation at a well for subsea production of oil or gas and adapted to be connected to a production vessel at the sea surface, comprising a main or fluid swivel having at least two fluid passages and an electric/hydraulic auxiliary swivel for signal communication and power transfer.

BACKGROUND OF THE INVENTION

When developing marginal offshore production fields it is important to keep the costs low. A substantial cost factor with known forms of development, is due to subsea pipelines and cables between christmas trees at the wells and product receiver sites, for example a platform or a floating production vessel. Typically there may here be the question of distances like 2 km. In this connection it is to be noted that modern drilling technology makes it possible to produce by means of a reduced number of christmas trees, because the boreholes or wells can have several branches. This will make it possible to develop subsea fields in some instances by employing only one subsea christmas tree.

International patent application PC/NO96/00201 dated Jul. 8, 1996 relates to a system for offshore production of hydrocarbons by employing a moored production vessel or ship. The present invention can be regarded as a further development thereof and is based on the idea that the production vessel can by lying directly above or in the immediate vicinity of the christmas tree at the seabed and that the well fluid flows are transferred directly between the christmas tree and the vessel without relying on pipelines or cables on the seabed.

Advantageously the solution to be described in the following specification can employ a particular and preferably simplified form of christmas tree, being more or less integrated into an arrangement according to the invention as will appear from the following description.

Thus, in a device as stated in the introduction above, the novel and specific features according to the invention primarily comprise therein that the fluid swivel is provided with a rotatable swivel housing at the top of a stationary christmas tree, preferably comprising a small number of valves, such as a production master valve and an annulus master valve, and that said passages are through-running vertically in a central core member of the fluid swivel in order to make possible well intervention from the upper side of the fluid swivel.

On the basis of this fundamental solution, which in actual practice can be embodied in various forms, it is possible to obtain a number of advantages, of which in particular the following are mentioned:

The production vessel employed does not need any modifications worth mentioning, in relation to common ship designs, and therefore will be relatively inexpensive, the same production vessel can be used for installing and possibly retrieving the swivel device, or also for well maintenance, which contributes to reduced operational costs, very small marginal subsea fields can be profitable by using this novel arrangement, so that the degree of extraction can be increased for the fields, the equipment employed can be re-used by moving it from field to field.

SUMMARY OF THE INVENTION

The present invention is a swivel device for installation at a well for subsea production of oil or gas and adapted to be connected to a production vessel at the sea surface comprising a main fluid swivel having at least two passages and an auxiliary swivel. The swivel device is provided with a rotatable swivel housing on top of a stationary christmas tree and that the passages are through-running vertically in a central core member of the fluid swivel, in order to make possible well intervention from the upper side of the fluid swivel. Further, at the lower part of the christmas tree, there is provided a force transferring housing being rotatably journalled about a common vertical axis on a base structure. The swivel device further comprises a mooring yoke having two legs, the free ends of which are rotatably connected to either side of the force transferring housing, and the opposite ends of which are adapted to be attached to the end of a mooring line. Between the force transferring housing and the swivel housing, there is provided a mechanical coupling for causing the swivel housing to perform the same rotary movements as the force transferring housing under the influence of the yoke.

Further, the mechanical coupling between the force transferring housing and the swivel housing comprises a rod element extending in parallel to the common vertical axis at the side of the christmas tree and the swivel housing.

The swivel device of the present invention may further comprise a retrievable top member incorporating the auxiliary swivel. The top member at its lower part is provided with a connector adapted to cooperate with the core member of the fluid swivel.

The top member may further contain a control module for the christmas tree and may be provided with a handling head for installation and retrieval.

The swivel device of the present invention may further comprise a bridging arm extended outwards and downwards from the top member and provided with a connector plate at its lower end. The connector plate is adapted to cooperate with a complementary connector part associated with a laterally projecting connecting member on the swivel housing.

A further embodiment of the instant invention provides the swivel housing with laterally directed connecting members for at least two risers being oriented substantially in the same plane as a connecting member for an umbilical. The connecting members are directed substantially outwards centrally between the yoke legs.

The swivel device may be characterized such that the wellhead comprises a conductor tube, characterized in that the force transferring housing is rotatably provided on a base structure being connected to the conductor tube for transferring mooring forces directly from the yoke to the conductor tube.

BRIEF DESCRIPTION OF THE DRAWINGS

In the following description the invention will be explained more closely with reference to the drawings, in which.

DETAILED DESCRIPTION OF THE PREFERRED EMBODIMENT

Figure 1:
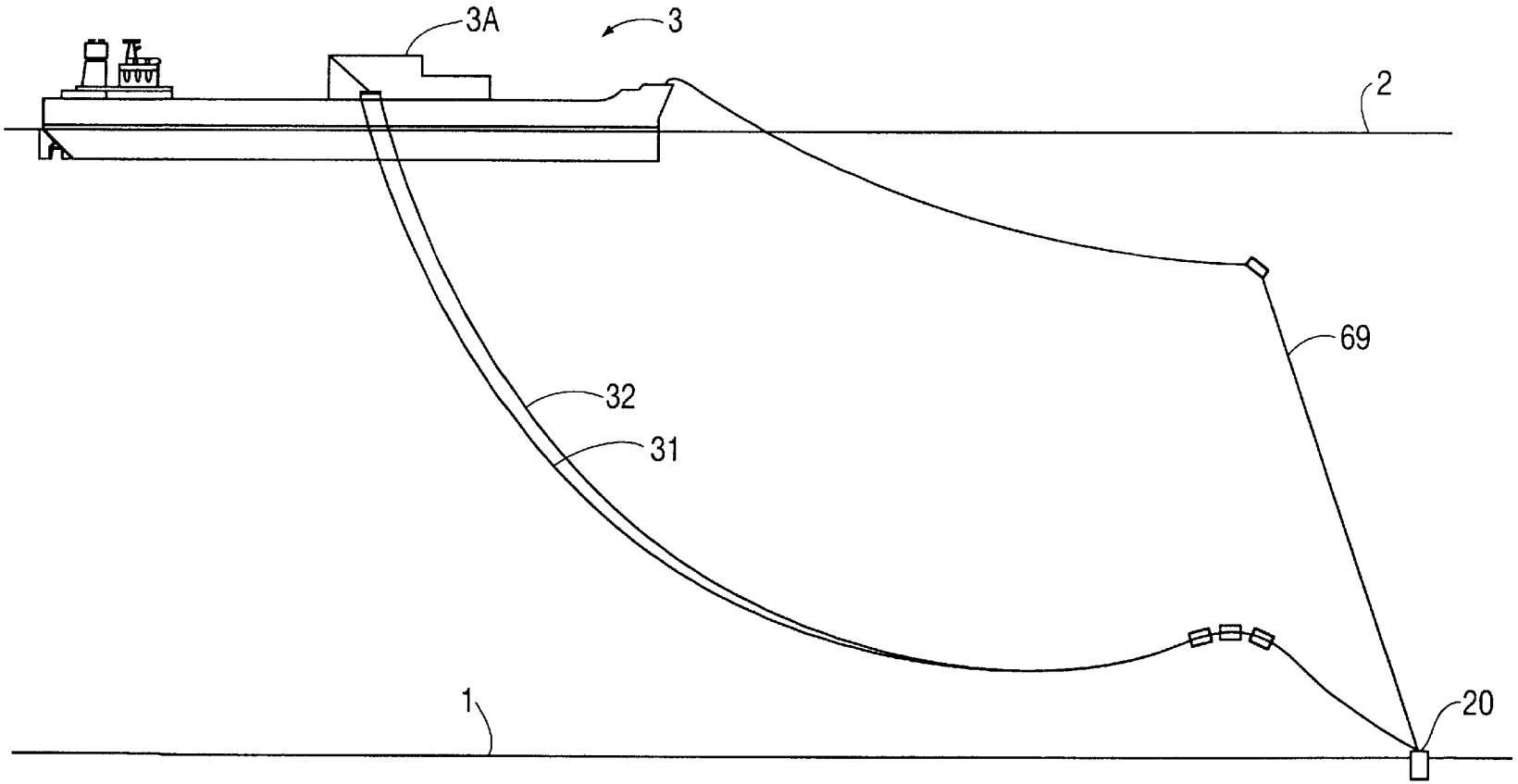
FIG. 1 shows a simplified overview of a total arrangement with a production vessel associated with an installation at the seabed and being moored thereto.

FIG. 1 shows an overview of the total arrangement when a production vessel or ship 3 operates in association with a well or a similar installation as generally shown at 20 on the seabed 1. Risers or hoses 31 and 32 are shown here in their full length up to the ship 3, where they are connected to a processing unit 3A being shown purely schematically. Moreover a mooring line 69 is extending up through the sea surface 2 to mooring means at the bow portion of the ship 3. An intermediate region of the mooring line 69 is provided with a buoyancy element and likewise the risers 31 and 32 have buoyancy bodies at a lower portion for elevating the risers or hoses from the bottom 1. This general system is described more closely in the above mentioned International patent application.

Figure 2:
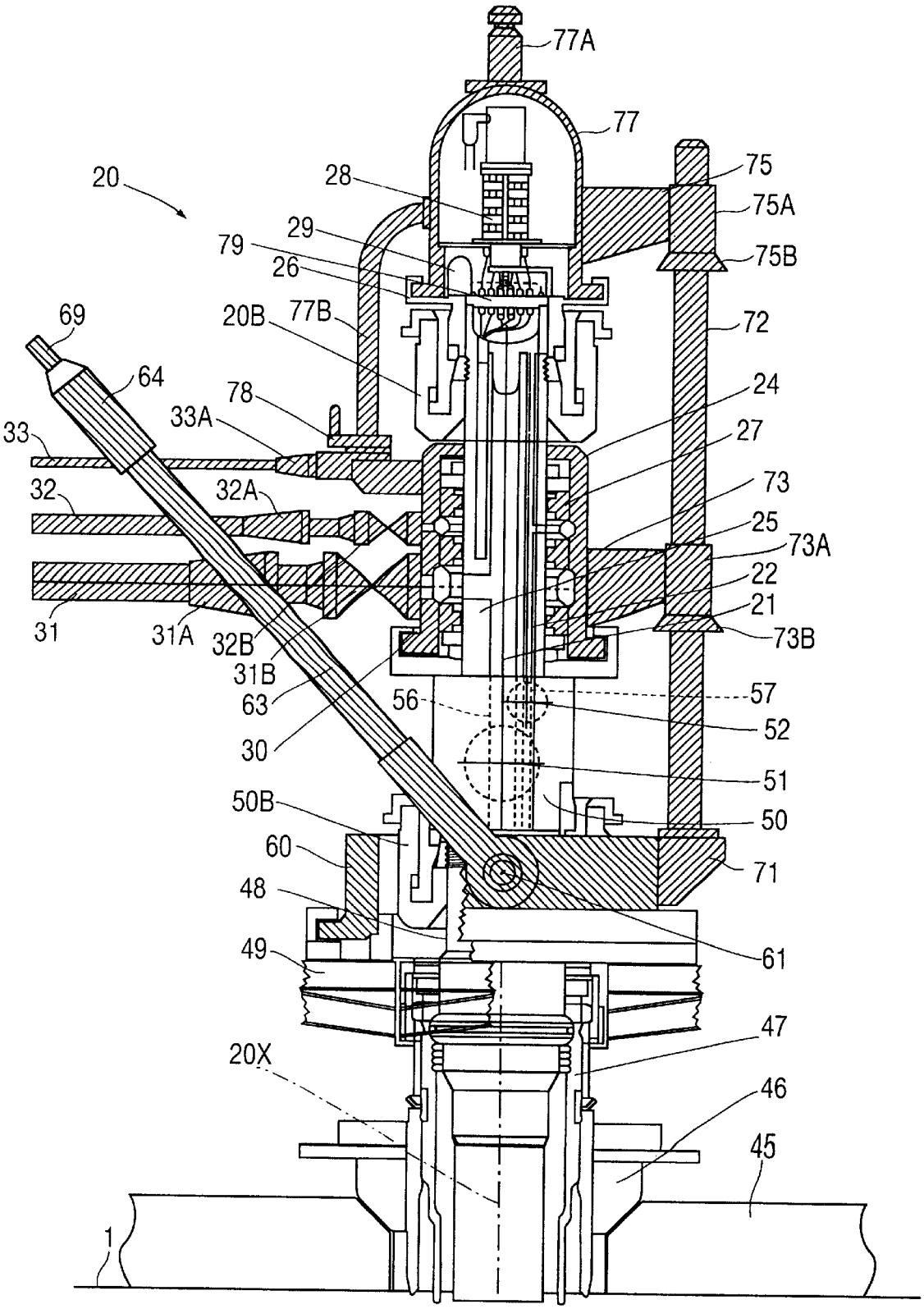
FIG. 2 shows an example of a preferred embodiment of the device according to the invention, as seen in elevation and partially in section.

In FIG. 2 there is indicated with hatching those parts and components which take part in the swing or turning movement when a production vessel moves around a subsea installation under the influence of wind and weather, in particular waves. The arrangement is preferably built up with a central and common vertical axis 20X coinciding with the axis of a wellhead 48, i.e. the top of the production tubing, when a subsea oil or gas well is concerned.

FIG. 2 in relatively much detail primarily shows more or less common structures at the top of an oil or gas well at the seabed 1. A concrete plate or base 45 forms a foundation on seabed 1 and has a central opening for supporting a self-adjusting ball joint type frame 46 which in turn is connected to a common conductor tube 47. In a known manner this can extend for several tens of meters down into the structure underneath the seabed 1. Within conductor tube 47 the actual production tubing is hanging, and ending at the top in the wellhead 48 itself.

A base structure 49 serves for supporting the whole arrangement above it. Through strong, supporting structure elements the base structure 49 is directly connected to the conductor tube 47 for transferring mooring forces thereto. Journalled at the base structure 49 there is shown a strong, carousel-like housing 60 being rotatable about the central axis 20X. Housing 60 is provided with preferably diametrically opposed attachment members 61 in the form of projecting studs for a yoke 63, the upper end 64 of which is adapted to be connected to one or more mooring lines 69. It will be seen that yoke 63 has two legs being united at an upper end or cross piece 64. Yoke 63 can assume various angular positions by swinging about the horizontal axis extending diametrically between the attachment members 61, whereby the angular range of the yoke movement at least extends upwards to an approximate vertical position, whereas the lowermost angular position in practice is restricted in view of umbilical 33 and/or risers 31 and 32.

During operation with a moored production vessel, this, through the intermediary of line or lines 69 and thereby yoke 63, will cause rotation of the hatched parts of the arrangement about the axis 20X. A corresponding rotary movement takes place in the actual swivel device, whereby the central core member 25 is stationary together with valve block 50, whereas the remaining parts of the swivel including the swivel housing 24 participate in the rotary movement. Thus, swivel housing 24 is journalled at 30 on top of valve block 50.

In order to secure a simultaneous and common rotary movement of housing 60 and swivel housing 24, there is shown a mechanical guide or coupling in the form of an upright rod element 72 being supported at its lower end by a bracket 71 attached to housing 60, and further up extending through a sleeve 73A on a supporting arm 73 projecting laterally from swivel housing 24. This mechanical coupling has been made sufficiently rigid for swivel housing 24 to perform the same rotary movements as the carousel or housing 60 under the influence of yoke 63, when this is connected to a surface vessel through mooring line 69. In addition to the rotary interconnection between housing 60 and the fluid swivel housing 24 as just explained, rod element 72 in cooperation with sleeve 73A can also have a useful and advantageous function during installation of the swivel device on a wellhead. For this purpose sleeve 73A has a downward wide cone 73B for cooperation with the upper end of rod element 72 when landing the fluid swivel and possible christmas tree 50 on wellhead 48. The christmas tree or block 50 at its lower part has a mounting or connector device 50B for detachable mounting on wellhead 48, as previously known per se.

Swivel device 50 has a stationary, central core member 25 with axially through bores or passages comprising a production bore 21 and an annulus bore 22. Both of these communicate downwards with corresponding fluid passages or conduits in valve block 50, for the purpose, inter alia, of the various valve functions made possible thereby. Specifically it is to be noted in this connection that these fluid bores or passages extend vertically from the top of the central core member 25 of the swivel and preferably with direct prolongation in corresponding passages 56,57 as indicated in christmas tree 50. Thus, well intervention from the upper side of the fluid swivel is made possible. This however, is on condition that a top member 77 of the total swivel device is removed, as will be described more closely below.

Moreover, around core member 25 the swivel device 20 has two or more annular fluid passages with associated seals and bearing elements, as generally shown at 27. These parts of a fluid swivel are previously known per se, for example from Norwegian patent No. 177.780, illustrating an axially separable swivel device, being primarily intended for other uses.

Swivel housing 24 is provided with connecting members generally denoted 31A and 32A for risers or hoses 31 and 32 adapted to extend upwards through the water to the production vessel. (See FIG. 1). Whereas connecting members 31A and 32A for fluid transfer are located relatively centrally at swivel 20, an upper connecting member 33A for an umbilical 33 is located at an upper part of swivel housing 24, being adapted to rotate about axis 20X during the turning movements mentioned. A bearing 30 supports swivel housing 24 so that it can rotate in relation to the christmas tree or block 50.

By means of a connector 20B a top member represented by its encasing 77 is incorporated in the total swivel device 20 in FIG. 2. Connector 20B permits separation of top member from and retrieval thereof from the remaining swivel device, as will appear from the following description. An auxiliary swivel 28 for transferring signals and power, is located in top member 77 and this also accomodates a control module 29 for the christmas tree. A slip ring mechanism 79 serves for the required rotary coupling of the various wire connections between said components in top member 77 and christmas tree 50, possibly also other units being incorporating in the wellhead.

On the other hand there are provided electric and hydraulic connections from top member 77 through a bridging arm 77B extending from a sidewall of the top member encasing 77 outwards and downwards along the side of connector 20B, and provided with a connector plate 78 or the like for cooperation with a complementary connector part on a connecting member 33A for umbilical 33. Accordingly, this can, through connection 78, bridge arm 77B and the interior of top member 77 including slip ring mechanism 79, communicate with christmas tree 50 and so forth.

As indicated with reference numeral 26 at the lower part of top member 77, this is rotatably journalled on connector 20B. A synchronous and simultaneous rotary movement of top member 77 under the influence of yoke 63 is secured by means of rod element 72, entering into a sleeve 75A connected to the top member encasing 77 through a radial arm 75. Sleeve 75A has a downwardly open cone 75B which like cone member 73B below, contributes to a safe landing and installation of top member 77 separately on the upper end of core member 25, at the same time as connection is established at 78. For such installation or retrieval of top member 77 this is provided with an upper handling head 77A, which in a manner known per se can be configured and dimensioned for cooperation with suitable tools. It is obvious that these operations by means of handling head 77A can also depending on the circumstances, comprise the whole swivel device, including the fluid swivel 24,27 and the christmas tree or block 50 as well as connector 50B thereon, for installation at wellhead 48.

The laterally directed connecting members 31A and 32A for risers are preferably oriented in the same plane as connecting member 33A for umbilical 33, and all connecting members are preferably directed substantially outwards from swivel housing 24 centrally between the yoke legs 63. It can be practical to provide isolation valves 31B and 32B between the connecting members and swivel housing 24, as will appear from FIG. 2. These isolation valves can also act as wing valves, which can be of interest in view of the preferred, simple form of christmas tree 50.

What is claimed is:

1. A swivel device for installation at a well for subsea production of oil or gas and adapted to be connected to a production vessel at the sea surface, comprising:

main fluid swivel having at least two passages, a central core member, and an auxiliary swivel, wherein the fluid swivel is provided with a rotatable swivel housing on top of a stationary christmas tree;

wherein said passages are through-running vertically in said central core member of the fluid swivel, in order to make possible well intervention from the upper side of the fluid swivel;

a force transferring housing at the lower part of the christmas tree, said force transferring housing being rotatably journalled about a common vertical axis on a base structure;

a mooring yoke having two legs, the free ends of said legs are rotatably connected to at either side of said force transferring housing, and the opposite ends of said legs adapted to be attached to the end of a mooring line; and a mechanical coupling provided between said force transferring housing and said swivel housing for causing said swivel housing to perform the same rotary movements as said force transferring housing under the influence of said yoke.

2. The swivel device according to claim 1, wherein said passages in the core member are aligned in direct prolongation of corresponding passages in the christmas tree.

3. The swivel device according to claim 2, wherein said core member projects somewhat upwardly from the upper side of the swivel housing.

4. The swivel device according claim 2, further comprising a retrievable top member incorporating said auxiliary swivel, said top member being at its lower part provided with a connector adapted to cooperate with the core member of the fluid swivel.

5. The swivel device according to claim 2, wherein said swivel housing is provided with laterally directed connecting members for at least two risers being oriented substantially in the same plane as a connecting member for an umbilical, said connecting members being directed substantially outwards centrally between the yoke legs.

6. The swivel device according to claim 2, whereby the well includes a wellhead which comprises a conductor tube, wherein said force transferring housing is rotatably provided on a base structure being connected to said conductor tube for transferring mooring forces directly from said yoke to the conductor tube.

7. The swivel device according to claim 1, wherein said mechanical coupling between said force transferring housing and said swivel housing comprises a rod element extending in parallel to said common vertical axis at the side of the christmas tree and the swivel housing.

8. The swivel device according to claim 7, wherein said rod element is attached at its lower end to said force transferring housing and cooperates with a sleeve at the outer end of an arm the inner end of which is attached to said swivel housing, said sleeve having a downward guide cone for cooperation with the upper end of said rod element.

9. The swivel device according to claim 7, whereby the well includes a wellhead which comprises a conductor tube, wherein said force transferring housing is rotatably provided on a base structure being connected to said conductor tube for transferring mooring forces directly from said yoke to the conductor tube.

10. The swivel device according to claim 1, further comprising a retrievable top member incorporating said auxiliary swivel, said top member being at its lower part provided with a connector adapted to cooperate with the core member of the fluid swivel.

11. The swivel device according to claim 10, wherein said top member is rotatably journalled on said connector.

12. The swivel device according to claim 11, wherein said top member contains a control module for said christmas tree.

13. The swivel device according to claim 11, wherein a bridging arm is extended outwards and downwards from said top member and is provided with a connector plate at its lower end, adapted to cooperate with a complementary connector part associated with a laterally projecting connecting member on said swivel housing.

14. The swivel device according to claim 11, wherein said top member is provided with a handling head for installation or retrieval of said top member.

15. The swivel device according to claim 10, wherein said top member is provided with a handling head for installation or retrieval of said top member.

16. The swivel device according to claim 10, wherein said top member is provided with an arm carrying a sleeve with a cone adapted to cooperate with said rod element.

17. The swivel device according to claim 1, wherein said swivel housing is provided with laterally directed connecting members for at least two risers being oriented substantially in the same plane as a connecting member for an umbilical, said connecting members being directed substantially outwards centrally between the yoke legs.

18. The swivel device according to claim 17, wherein between said connecting members for risers and the swivel housing, there are provided isolation valves.

19. The swivel device according to claim 1, whereby the well includes a wellhead which comprises a conductor tube, wherein said force transferring housing is rotatably provided on a base structure being connected to said conductor tube for transferring mooring forces directly from said yoke, to the conductor tube.

20. The swivel device according to claim 1, wherein said core member projects somewhat upwardly from the upper side of the swivel housing.

* * * * *